US007617748B1

(12) United States Patent
Chenelia

(10) Patent No.: US 7,617,748 B1
(45) Date of Patent: Nov. 17, 2009

(54) WATCHBAND BOTTLE OPENER

(76) Inventor: Dominic A. Chenelia, 2151 W. California St., San Diego, CA (US) 92110

( * ) Notice: Subject to any disclaimer, the term of this patent is extended or adjusted under 35 U.S.C. 154(b) by 0 days.

(21) Appl. No.: 12/188,920

(22) Filed: Aug. 8, 2008

(51) Int. Cl.
*B67B 7/16* (2006.01)
*A44B 11/24* (2006.01)

(52) U.S. Cl. ..... 81/3.55; 81/3.09; 81/3.4

(58) Field of Classification Search ..... 81/3.55, 81/3.57, 3.4, 3.09, 3.07; D8/33, 34, 38, 18; 7/151
See application file for complete search history.

(56) References Cited

U.S. PATENT DOCUMENTS 898,366 A * 9/1908 Hough ..... 81/3.09
2,470,606 A * 5/1949 Dennison ..... 81/3.55
2,807,085 A * 9/1957 Combs ..... 81/3.09
3,103,047 A * 9/1963 Wolf, Jr. ..... 81/3.09
3,175,233 A * 3/1965 Caravella ..... 81/3.09
4,384,390 A * 5/1983 Hayakawa ..... 7/151
6,360,391 B1 * 3/2002 Goodall ..... 7/151
7,370,558 B1 5/2008 Chenelia
2007/0163393 A1 * 7/2007 Ondeck et al. ..... 81/3.57

* cited by examiner

*Primary Examiner*—Hadi Shakeri
(74) *Attorney, Agent, or Firm*—Gordon & Rees LLP

(57) ABSTRACT

A bottle opening wristband, having: a pivot member; a buckle loop rotatably connected to the pivot member; and a projection extending from a side edge of the buckle loop, the projection being dimensioned to be received under an edge of a bottle cap.

6 Claims, 4 Drawing Sheets

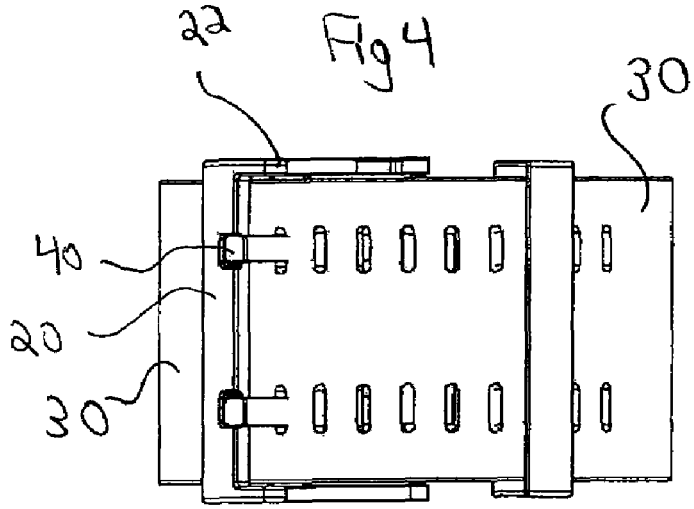
Fig 4
Fig 5
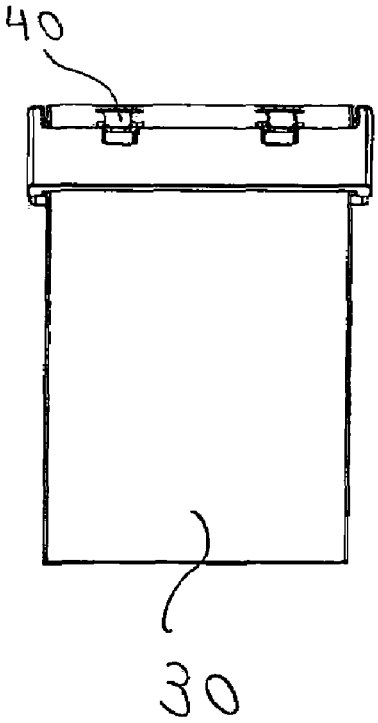
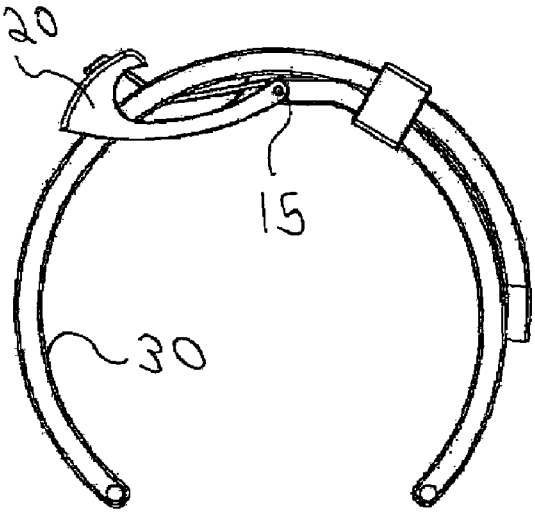
Fig 3

WATCHBAND BOTTLE OPENER

TECHNICAL FIELD

The present invention is a wristwatch buckle designed to open bottle caps.

BACKGROUND OF THE INVENTION

Bottle cap openers are notoriously easy to lose, and are often misplaced in the kitchen. This is especially true of small bottle cap openers.

Sometimes, bottle cap openers are attached to key chains. Such bottle cap openers are typically used as advertising, with various corporate or sports team's logos prominently displayed thereon. These sorts of bottle cap openers often tend to be bulky and gaudy, especially when dangling or rattling on a user's key chain.

It is therefore instead desired to provide a bottle cap opener that is easy to find, and easy to use. It is also desired that such a bottle cap opener be discrete, and can be carried around by a user without drawing attention to the user.

SUMMARY OF THE INVENTION

The present invention provides a bottle opening wristband, comprising: a pivot member; a buckle loop rotatably connected to the pivot member; and a projection extending from a side edge of the buckle loop, the projection being dimensioned to be received under an edge of a bottle cap. In further aspects, the invention also comprises a watchband, wherein the pivot member and the buckle loop are connected to the watchband, and wherein the buckle loop is dimensioned to receive a bottle cap therein with the projection reaching under the edge of the bottle cap while an opposite portion of the buckle loop rests against the watchband.

BRIEF DESCRIPTION OF THE DRAWINGS

FIG. 3 is a side elevation view of the present invention.

FIG. 4 is a bottom plan view of the present invention.

FIG. 5 is an end elevation view of the present invention.

DETAILED DESCRIPTION OF THE DRAWINGS

The present invention is a bottle opening wristband that is small, compact and discrete. It can be carried around by a user without drawing any attention to the user.

Figure 2:
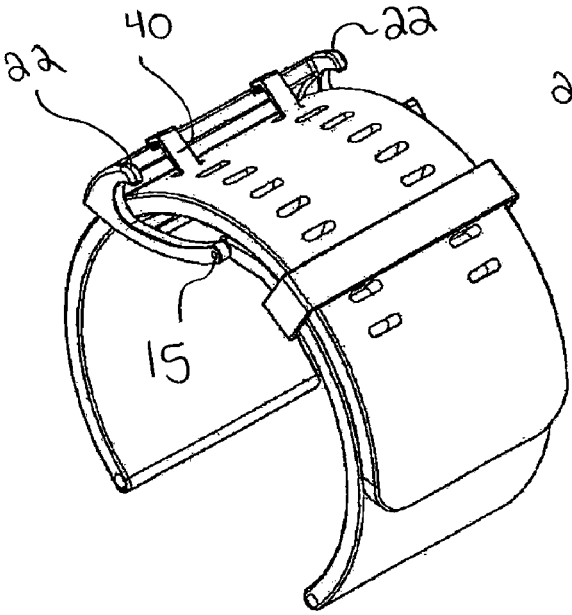
FIG. 2 is a second perspective view of the present invention.
Figure 1:
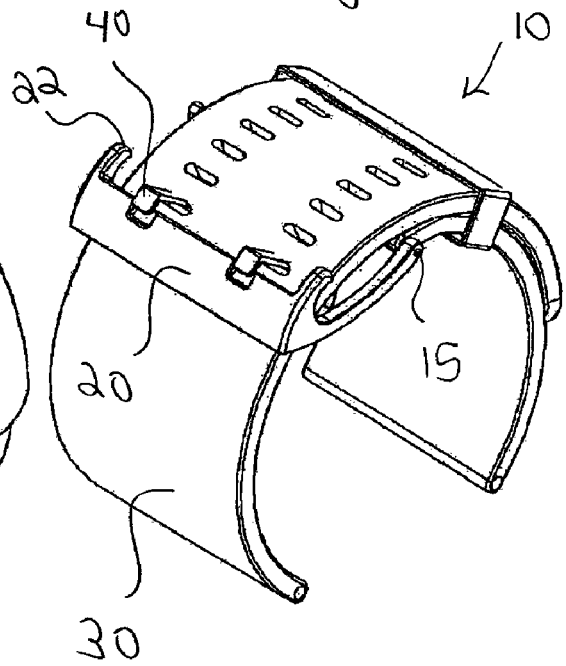
FIG. 1 is a first perspective view of the present invention.
Figure 7:
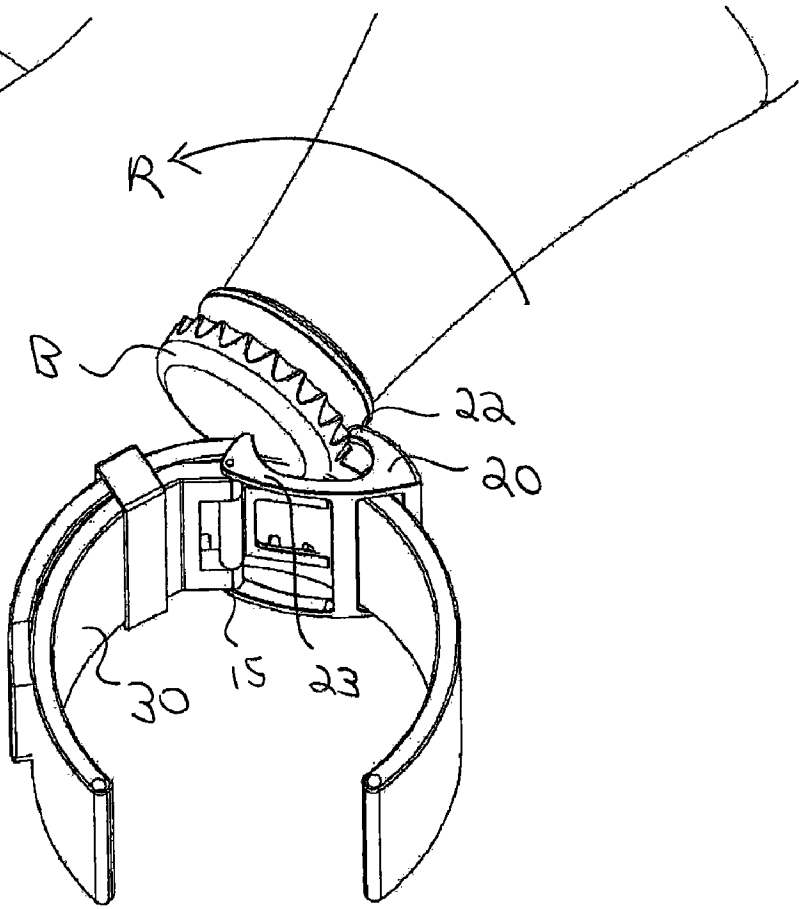
FIG. 7 is a side perspective view of the invention in operation removing a bottle cap.
Figure 6:
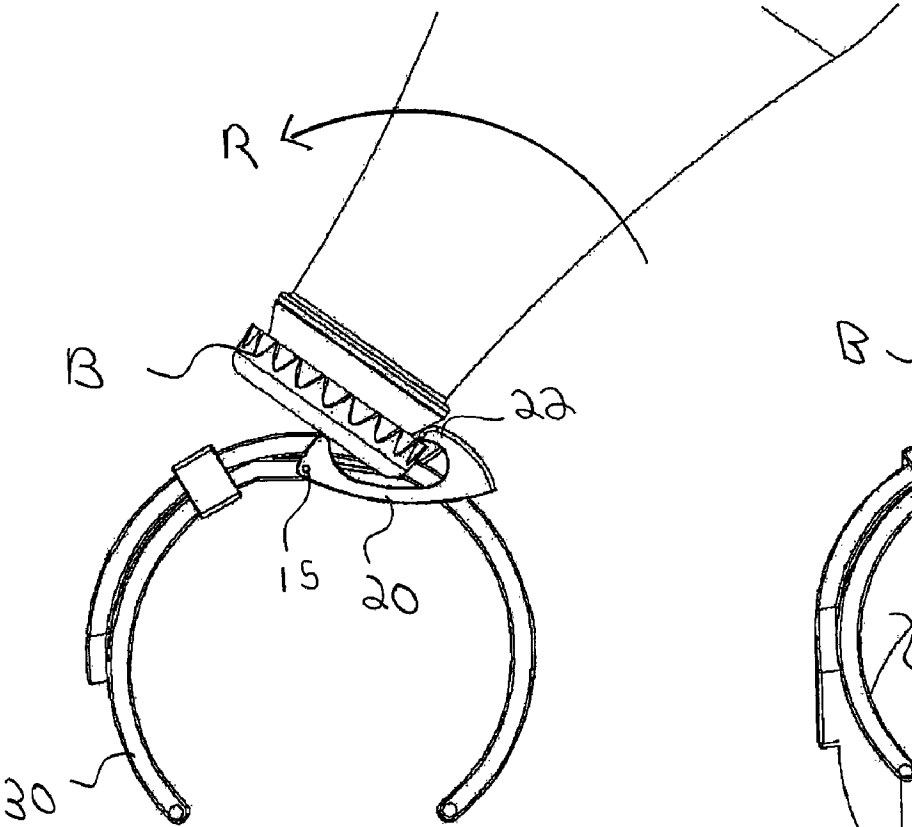
FIG. 6 is a side elevation view of the invention in operation removing a bottle cap.
Figure 8:
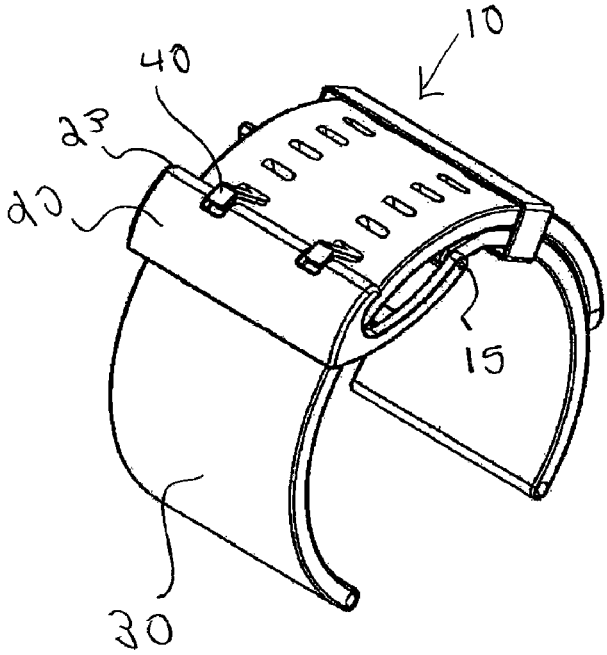
FIG. 8 is a perspective view of a second embodiment of the present invention.
Figure 9:
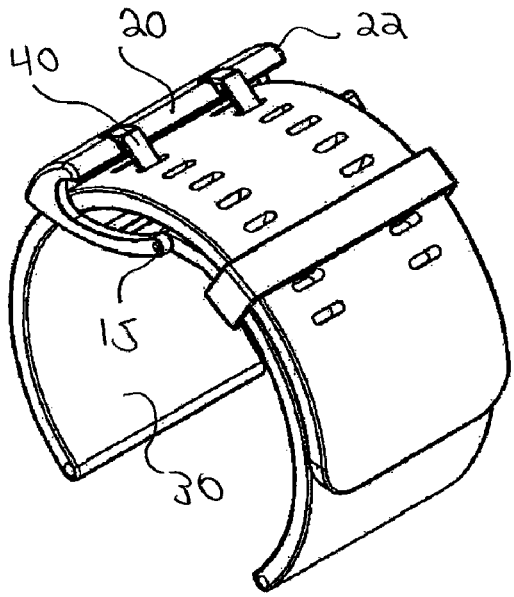
FIG. 9 is a second perspective view of the second embodiment of the present invention.

FIGS. 1 to 5 illustrate the parts of the present invention; FIGS. 6 and 7 illustrate the present invention in operation; and FIGS. 8 and 9 illustrate a second embodiment of the present invention, as follows.

The present invention includes a bottle opening wristband 10, comprising: a pivot member 15; and a buckle loop 20 rotatably connected to pivot member 15. A watchband 30 is also included. Pivot member 15 and buckle loop 20 are connected to watchband 30.

A projection 22 extends from each of the opposite side edges of buckle loop 20. (It is to be understood, however, that only one projection 22 is required in accordance with the present invention. Moreover, as seen in FIGS. 8 and 9, opposite projections 22 may form a common face with the end of buckle loop 20).

As seen in FIGS. 6 and 7, projection 22 is dimensioned to be received under an edge of a bottle cap B. Thus, when bottle cap B is received into buckle loop 20, projection 22 reaches under the edge of bottle cap B while an opposite portion 23 of buckle loop 22 rests against a top of the bottle cap. (I.E.: opposite portion 23 of buckle loop 22 is the portion of buckle loop 22 that is adjacent to pivot member 15).

Thus, the user will position the bottle cap as shown in FIGS. 6 and 7 such that protrusion 22 on buckle loop 20 is received under the edge of bottle cap B while the opposite portion 23 of buckle loop 20 rests on top of bottle cap B. The user simply rotates the bottle in direction R), and bottle cap B "pops off" of the bottle.

As can also be seen, buckle loop 20 and watch band 30 are dimensioned such that bottle cap B is received somewhat against the side of buckle loop 20 when projection 22 is received under an edge of bottle cap B. The degree to which the bottle is placed to the side of buckle loop 20 depends upon the relative dimensions of buckle loop 20, projection 22 and watchband 30. For example, should watchband 30 be thicker, the bottle cap B may be placed more towards one side of buckle loop 20. It is to be understood that the present invention is not limited to any particular positioning or embodiment in this regard.

As can also be seen, one or more clasps 40 may also be included. Clasps 40 are rotatably connected to pivot member 15, and clasps 40 can be rotated into a position against buckle loop 20 (as shown). As can also be seen, buckle loop 20 may comprise indents 21 into which the ends of clasps 40 are received.

What is claimed is:

1. A bottle opening wristband comprising:

a pivot member extending in a first direction and having first and second ends;

a buckle loop having a proximal end rotatably connected to the pivot member, said buckle loop including first and second arms each defining first and second ends, wherein the first end of each arm is rotatably connected to said first and second ends of said pivot member respectively, and wherein said arms extend in a second direction substantially perpendicular to said first direction; and a projection extending from an outer lateral side edge of a distal end of the buckle loop at said second end of said first arm and extending outwardly away from said first arm, the projection being dimensioned to be received under an edge of a bottle cap wherein the buckle loop is dimensioned to receive a bottle cap therein with the projection at the distal end of the buckle loop reaching under the edge of the bottle cap while the proximal end of the buckle loop rests against a top of the bottle cap.

2. The bottle opening wristband of claim 1, wherein the buckle loop is dimensioned such that a bottle cap is received against the side of the buckle loop when the projection is received under an edge of the bottle cap.

3. The bottle opening wristband of claim 1, further comprising:

a watchband, wherein the pivot member and the buckle loop are connected to the watchband.

4. The bottle opening wristband of claim 1, further comprising:

a clasp rotatably connected to the pivot member, wherein the clasp can be rotated into a position against the buckle loop.

5. The bottle opening wristband of claim 4, wherein the buckle loop has an indent into which an end of the clasp is received.

6. The bottle opening wristband of claim 1, further comprising: a second projection extending from an opposite outer lateral side edge of an opposite side of the distal end of the buckle loop at said second end of said second arm and extending outwardly away from said second arm, the second projection also being dimensioned to be received under an edge of a bottle cap.

* * * * *